United States Patent [19]

Wood

[11] 3,985,268

[45] Oct. 12, 1976

[54] NON-DRIP DISPENSER

[76] Inventor: Laurier A. Wood, 550 Newtown Road, Littleton, Mass. 01460

[22] Filed: Nov. 24, 1975

[21] Appl. No.: 634,515

[52] U.S. Cl. ..... 222/108; 222/210; 222/214; 222/323; 222/325; 222/468; 222/470

[51] Int. Cl.[2] ..... B67D 1/16; B67D 37/00

[58] Field of Search ..... 222/210, 214, 323, 468, 222/470–474, 108, 109, 389, 397, 386.5, 325, 95

[56] References Cited

UNITED STATES PATENTS

| | | | |
|---|---|---|---|
| 2,838,210 | 6/1958 | Detrie et al. | 222/473 X |
| 3,258,176 | 6/1966 | Raczynski | 222/468 X |
| 3,871,553 | 3/1975 | Steinberg | 222/397 |
| 3,938,709 | 2/1976 | Collar | 222/325 |

*Primary Examiner*—Allen N. Knowles
*Attorney, Agent, or Firm*—Wolf, Greenfield & Sacks

[57] ABSTRACT

The dispenser may be in the form of a dispensing gun and is preferably used to dispense a low viscosity material such as a cynoacrylate glue. The dispenser includes a handle and a holder supported from the handle. The holder comprises a body defining a chamber in which the glue bottle is disposed and an end cap having a nozzle and into which the bottle is threadedly engaged. The handle has a venturi tube therein which receives a pressurized air flow and couples the air flow to the holder, and a valve means coupled to the venturi tube. When the valve means is open the pressurized air is vented to the atmosphere causing a partial vacuum (negative pressure) in the holder on the bottle thereby sucking any excess material into the bottle. When the valve means is operated to its closed position the pressurized air is directed to the holder causing the bottle to contract and thereby force metered amounts out of the nozzle of the dispenser.

7 Claims, 2 Drawing Figures

NON-DRIP DISPENSER

BACKGROUND OF THE INVENTION

The present invention relates, in general, to a dispenser for fluids and in the disclosed embodiment the dispenser is for dispensing glue material such as cynoacrylate glue. More particularly, this invention pertains to a non-drip dispenser especially useful for dispensing low viscosity materials.

There are certain problems associated with the dispensing of liquid materials such as a cynocrylate glue. For one thing, the material that is being dispensed tends to drip after a certain amount has been dispensed because the viscosity of the material may be very low say on the order of 1–2000 centipoise. When the material is thinned and of a water consistency, it is quite apt to flow out of the dispenser after a certain amount has been dispensed.

Another problem associated with some prior art dispensers is that they employ metal holders and the threads on the dispenser become bonded by the material that is to be dispensed therefore possibly making the dispenser inoperative. This problem is sometimes only overcome by substituting a different material such as polypropolene or polyvinyl chloride.

The prior art devices quite consistently teach the use of a reservoir for holding a predetermined amount of the material that is to be dispensed. See, for example, U.S. Pat. Nos. 2,529,937 and 2,823,953. One of the problems with this arrangement is that any material that is purchased must be transferred from the manufacturers shipping bottle to the dispensing device. This makes for a time consuming operation and there is a possibility of loss of some of the material. Also, if one attempts to apply a negative pressure or vacuum to the reservoir there is a possibility of sucking the material out of the reservoir and into the vacuum equipment. This, of course, is quite undesirable.

Accordingly, one object of the present invention is to provide an improved dispenser particularly adapted for use with a low viscosity liquid material.

Another object of the present invention is to provide a non-drip dispenser for a watery-like substance.

A further object of the present invention is to provide a fluid dispenser that directly accommodates the manufacturers shipping bottle thereby eliminating the need for a transfer of the liquid from the bottle to a reservoir of the dispensing unit.

Still another object of the present invention is to provide a fluid dispenser including a valve means or trigger means which is usable by an operator of the device to meter relatively precise amounts of the fluid which is being dispensed.

Still a further object of the present invention is to provide a non-drip dispenser wherein the material that is being dispensed is maintained in its original bottle and there is no possibility of communication of the material to other parts of the device such as the air lines.

SUMMARY OF THE INVENTION

To accomplish the foregoing and other objects of this invention there is provided a dispenser preferably for low viscosity liquid materials. This material is typically contained in a deformable bottle. The dispenser comprises a body defining a chamber in which the bottle is disposed. The body may be supported from a handle.

Means are provided for supporting the bottle in the chamber in a fixed position in the chamber. This supporting means includes a cap for the body having a dispensing nozzle. In one embodiment the bottle has screw threads and the cap has mating threads for receiving the bottle with its open end facing the dispensing nozzle. The end cap may also be provided with threads for threading onto the body with the bottle extending coaxially of the body. A source of pressurized fluid is provided. The specific pressure is preferably controlled by means of a regulator. The dispenser also comprises a valve means having an open position and a closed position. A venturi tube extends between the means for receiving a flow of pressurized fluid and the valve means, and means couple from the venturi tube to the chamber. This coupling between the tube and the chamber preferably commences at the restricting orifice of the venturi tube. The valve means may simply be a venting port which can be covered and uncovered by the operator's finger or the valve means may comprise a valve which is operated like a trigger and is normally in its open position wherein venturi action occurs causing a vacuum in the chamber for maintaining the liquid material in the bottle or retracting the material back into the bottle. When the valve means is closed the pressurized fluid is directed to the chamber causing the bottle to contract and thereby force an amount of liquid material from the dispensing nozzle as long as the valve means is maintained in this closed position.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
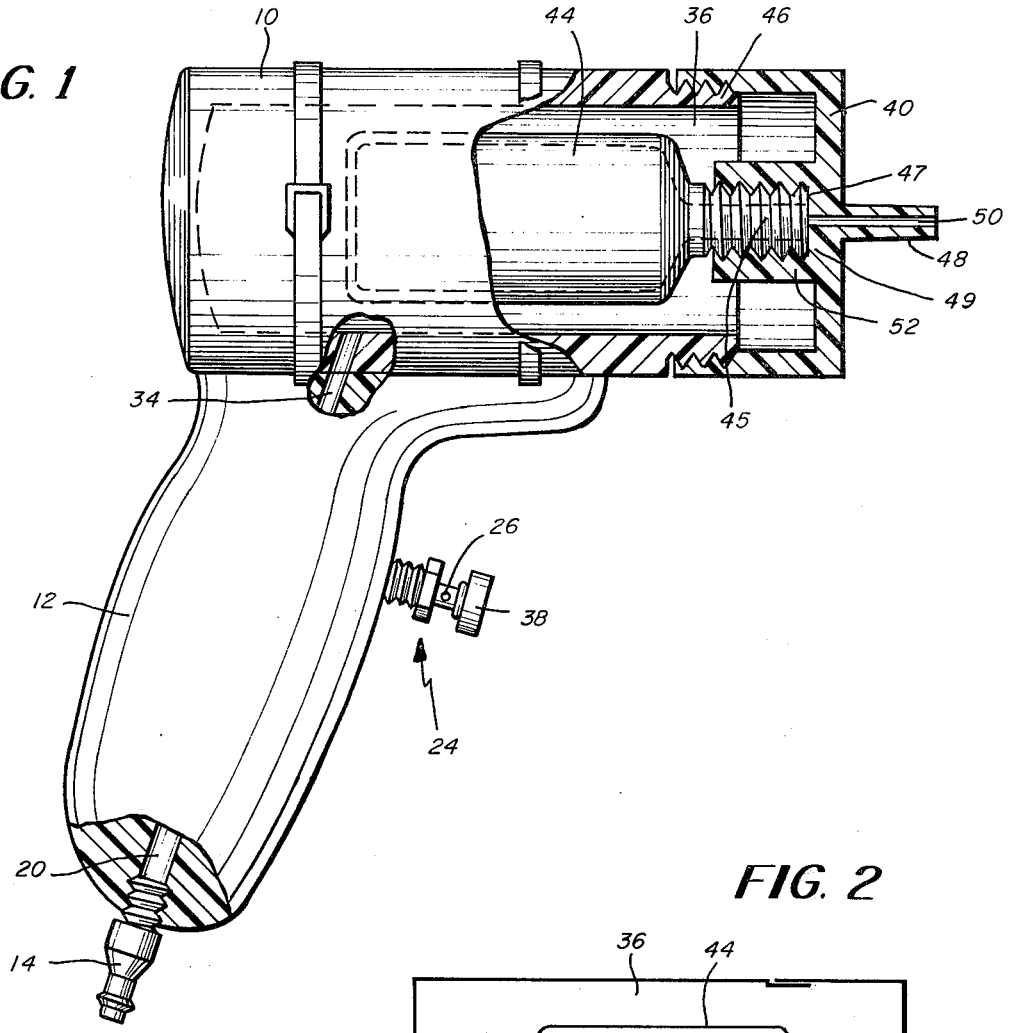
FIG. 1 shows the device of the present invention in a partially cut-a-way view.

Referring now to the drawings, the dispenser generally comprises a holder 10 which may be constructed of a plastic material and be of generally cylindrical shape, and a handle 12 which may be in the form of a gun handle. The handle 12 may be constructed of a solid material such as a hard epoxy. The venturi arrangement of the present invention is contained within the handle 12. In alternate embodiments of the invention the handle structure may be eliminated and a suitable support substituted therefore.

Figure 2:
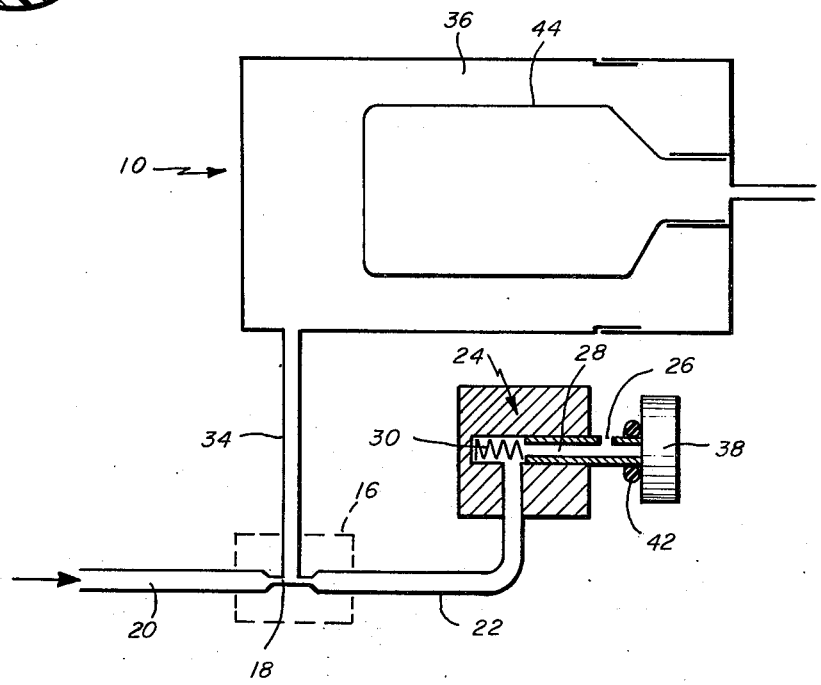
FIG. 2 shows the device is a more schematic manner disclosing the venturi arrangement of this invention.

FIG. 2 shows the venturi concept of the present invention as applied to the dispenser arrangement including the holder 10 shown in FIG. 1. A source of pressurized air or possibly other pressurized fluid is coupled to the input connector 14 of the device as shown in FIG. 1. The supply of air may be regulated and a gage may be associated with this supply so that the exact pressure coupled to the venturi device 16 can be precisely controlled. FIG. 2 shows the venturi tube which in itself is of conventional design and includes a restricting orifice 18. Line 20 couples from the input connector 14 to the venturi device 16. The output from the venturi device couples by way of line 22 to the valve 24. In FIGS. 1 and 2 the valve is shown in its open position permitting air flow through the venturi tube 16, the air being vented through an opening 26 in the hollow shaft 28 of the valve 24. FIG. 2 shows a spring 30 which urges the shaft 28 outwardly so that the hole 26 is exposed. The hole 26 communicates with the hollow inside of the shaft 28, and the shaft 28 in turn communicates with the line 22 connecting to the venturi tube.

FIG. 2 also shows another line 34 connecting from the restricted orifice 18 of the venturi tube to the cylindrical holder 10. In the open position of the valve 24 a vacuum is created via the line 34 in the chamber 36 defined by the cylindrical holder 10. The imposing of this vacuum is discussed in more detail hereinafter with reference to the more detailed description of the holder 10 and its associated cap 40.

The shaft 28 shown in FIG. 2 is movable within the housing of the valve 24 and a button 38 is provided for moving the shaft 28 inwardly to block the venting hole 26 and thereby move the valve to its closed position. To assure a tight closure, an O-ring 42 may also be provided disposed about the shaft 28 and sealing against the housing of the valve when the button 38 is fully depressed. When the valve 24 is closed by depressing the button 38 the pressurized air no longer flows through the venturi tube 16. Instead, the pressurized air will flow from the line 20 through the line 34 to the chamber 36 causing a contracting of the bottle 44 disposed in the chamber 36. It is the bottle 44 that contains the liquid material that is being dispensed. This material may be a cynoacrylate glue and may have a very low viscosity in the range of 1–2000 centipoise. As discussed hereinafter, this applied pressure is used for forcing predetermined amounts of the liquid material from the bottle 44.

The holder 10 has a threaded end 46 for receiving a threaded cap 40. The cap 40 has a hypodermic needle type nozzle 48 which defines a capillary size passage 50 through which the liquid material is dispensed. The cap 40 also has integrally formed therewith a cylindrical collar 52 which is internally threaded for receiving the bottle 44. The bottle 44 has a threaded top 45 which threads into the internally threaded collar 52. The top edge 47 of the bottle seats against wall 49 of the collar and provides a seal at the interface which prevents the liquid material in the bottle 44 from escaping from the bottle via any route other than through the nozzle 48.

The bottle 44 is the container that the liquid material is purchased in and it is noted that when the cap 40 is removed from the holder 10 after a bottle has been used, then the bottle is removed along with the cap and it is quite easy to remove the bottle 44 and screw a new bottle in place in the cap. The cap is then screwed onto the holder 10. The capillary passage 50 is preferably rather narrow so that there is some surface tension that also assists in preventing leakage of the liquid material from the container. A gasket or seal may also be provided between the bottle and the wall 49 of the collar so that a tight seal is provided at that interface.

When the button 38 has been depressed so that material will be dispensed from the device, the valve is moved to its closed position and pressure is applied to the chamber 36 causing the bottle 44 to contract. When this occurs, the liquid material within the bottle is forced from the nozzle 48 under control of the operation of the button 38. When the button 38 is released then the valve opens and the pressure flows through the venturi tube 16. A negative pressure or vacuum is created in the chamber 36 which tends to cause the bottle to revert to its initial shape. When the bottle is squeezed by the previously applied pressure the bottle may tend to remain deformed because of the partial vacuum that is created in the bottle by the dispensing of the liquid. However, because of the venturi action the bottle will not be able to be maintained depressed and thus reverts to its normal shape thereby assuring the existance of a partial vacuum in the bottle 44 which maintains the liquid material in the bottle and prevents it from seeping through the nozzle 48.

It is known that aerobic materials need air for them to harden. Conversely, anaerobic materials do not harden in the presence of air or alternatively the presence of air slows down the hardening process. Because in accordance with the present invention it is particularly desirable to dispense cynoacrylate material which is anaerobic, the fact that air can enter through the passage 50 is advantageous. When the material is sucked back into the bottle as it is restored to its original fully expanded shape, the air which is sucked into the bottle slows the setting of the liquid material.

Thus, in accordance with the present invention there is provided a dispenser which can accommodate very low viscosity materials and can be operated without dripping between application of the dispensed material. The dot size of the dispensed liquid can be quite accurately controlled by the operator. It is noted that the material is used directly in its shipping bottle thus there is no need for a transfer material as with other prior art devices. Because the bottle is sealed to the cap there should be no leakage of the liquid material other than through the nozzle as desired.

What is claimed is:

1. A dispenser for a liquid material that is contained in a deformable bottle, said dispenser comprising;

a body defining a chamber in which is disposed said bottle, means for supporting the bottle in the chamber in a fixed position including a cap for the body having a dispensing nozzle and receiving the open end of the bottle, means for receiving a flow of pressurized fluid, a valve means having an open position and a closed position, a venturi tube extending between the means for receiving a flow of pressurized fluid and the valve means, and means coupling from the venturi tube to the chamber, said valve means when open venting the fluid flow causing a vacuum in the chamber for maintaining the liquid material in the bottle, and when closed directing the pressureized fluid to the chamber causing the bottle to contract and thereby force an amount of liquid material from the dispensing nozzle.

2. A dispenser as set forth in claim 1 wherein the body includes a cylindrical member closed at one end and open at the other end and said cap fitting over an open end of the chamber.

3. A dispenser as set forth in claim 2 wherein said cap is threaded onto the member and has a centrally disposed collar for receiving the open end of the bottle.

4. A dispenser as set forth in claim 3 wherein said cap has means for assisting in sealing the bottle to the cap in a liquid tight manner.

5. A dispenser as set forth in claim 1 wherein said means for receiving a flow of pressurized fluid includes an input fluid line directing fluid to the venturi tube.

6. A dispenser as set forth in claim 5 wherein said venturi tube defines a restricted orifice and said means coupling from the venturi tube connects at the restricted orifice.

7. A dispenser as set forth in claim 1 wherein the valve means includes an actuating button and means for urging the button to its open position corresponding to an open position of the valve means.

* * * * *